US005464803A

United States Patent [19]

McGuinness et al.

[11] Patent Number: 5,464,803

[45] Date of Patent: Nov. 7, 1995

[54] PRESSURE-SENSITIVE RECORD MATERIAL

[75] Inventors: Gordon B. McGuinness, Chilwell; Richard D. Saunders, Windsor, both of England

[73] Assignee: The Wiggins Teape Group Limited, England

[21] Appl. No.: 70,777

[22] Filed: Jun. 3, 1993

[30] Foreign Application Priority Data

Jun. 4, 1992 [GB] United Kingdom ..... 9211854
Oct. 15, 1992 [GB] United Kingdom ..... 9221607

[51] Int. Cl.[6] ..... B41M 5/20

[52] U.S. Cl. ..... 503/213; 106/21 R; 428/402.2

[58] Field of Search ..... 428/327, 204, 428/321.5, 402.2, 205, 497, 499; 260/350.2; 503/213; 106/21 R

[56] References Cited

U.S. PATENT DOCUMENTS

| | | | |
|---|---|---|---|
| 2,712,507 | 7/1955 | Green | 117/36 |
| 2,730,457 | 1/1956 | Green et al. | 117/36 |
| 2,800,457 | 7/1957 | Green et al. | 252/316 |
| 2,800,458 | 7/1957 | Green | 252/316 |
| 3,016,308 | 1/1962 | Macaulay | 117/36.7 |
| 3,024,927 | 3/1962 | Quayle | 214/131 |
| 3,041,289 | 6/1962 | Katchen et al. | 252/316 |
| 3,672,935 | 6/1972 | Miller et al. | 117/36.8 |
| 3,753,761 | 8/1973 | Sugahara et al. | 117/36.2 |
| 3,966,632 | 6/1976 | Colliopoulos et al. | 252/309 |
| 4,001,140 | 1/1977 | Foris et al. | 252/316 |
| 4,027,065 | 5/1977 | Brockett et al. | 428/307 |
| 4,100,103 | 7/1978 | Foris et al. | 252/316 |
| 4,105,823 | 8/1978 | Hasler et al. | 428/307 |
| 4,181,639 | 1/1980 | Bomer et al. | 260/29.6 WB |
| 4,253,682 | 3/1981 | Baatz et al. | 282/27.5 |
| 4,379,071 | 4/1983 | Schnoring et al. | 252/316 |
| 4,396,670 | 8/1983 | Sinclair | 428/321.5 |
| 4,402,856 | 9/1983 | Schnoring et al. | 428/402.22 |
| 4,412,959 | 11/1983 | Wegner et al. | 264/4.1 |
| 4,428,983 | 1/1984 | Nehen et al. | 427/213.34 |
| 4,783,196 | 11/1988 | Eckstein et al. | 8/527 |
| 4,923,641 | 5/1990 | Eckstein et al. | 544/86 |

FOREIGN PATENT DOCUMENTS

| | | |
|---|---|---|
| 0024898 | 3/1981 | European Pat. Off. . |
| 0024897 | 3/1981 | European Pat. Off. . |
| 0086636 | 8/1983 | European Pat. Off. . |
| 0155593 | 9/1985 | European Pat. Off. . |
| 0234394 | 9/1987 | European Pat. Off. . |
| 0247816 | 12/1987 | European Pat. Off. . |
| 0262569 | 4/1988 | European Pat. Off. . |
| 0275107 | 7/1988 | European Pat. Off. . |
| 0390432 | 10/1990 | European Pat. Off. . |
| 0428994 | 5/1991 | European Pat. Off. . |
| 2618264 | 11/1976 | Germany . |
| 4110354 | 10/1991 | Germany . |
| 49-31414 | 3/1974 | Japan . |
| 51-080685 | 7/1976 | Japan . |
| 59-164186 | 9/1984 | Japan . |
| 60-238140 | 11/1985 | Japan . |
| 1526353 | 9/1978 | United Kingdom . |

OTHER PUBLICATIONS

Patent Abstracts of Japan, citing JP 59–138487 "Protective Material for Pressure–Sensitive Copying Paper", vol. 8, No. 267, Dec. 1984, and partial translation of JP 59–138487.

Database WPI, Week 7123, Abstract No. 71–401915 citing JP 71–21253, Derwent Publications Ltd., and translation of JP 71–21253.

Chemical Abstracts, vo. 81, No. 12, Sep. 1974.

Database WPI, Week 8133, Derwent Publications Ltd.

*Primary Examiner*—Patrick J. Ryan
*Assistant Examiner*—William A. Krynski
*Attorney, Agent, or Firm*—Burns, Doane, Swecker & Mathis

[57] ABSTRACT

A chromogenic composition for use in pressure-sensitive record material comprises chromogenic material in a vegetable oil vehicle. The vehicle is made up of at least a major proportion of relatively high melting vegetable oil which is solid or semi-solid at ambient temperatures of around 20°–25° C., and is substantially free of esters of an acid derivable from an animal or vegetable oil. The high melting vegetable oil can be coconut oil, palm oil, palm kernel oil and/or a hardened vegetable oil such as hardened soya bean oil or hardened coconut oil.

19 Claims, No Drawings

PRESSURE-SENSITIVE RECORD MATERIAL

This invention relates to pressure-sensitive record material, and more particularly to a chromogenic composition as used in such record material. Typically the record material is a pressure-sensitive copying paper of the kind known as carbonless copying paper.

Pressure-sensitive copying paper is widely used in the production of business forms sets. Various types of pressure-sensitive copying paper are available, of which the most widely used is the transfer type. A business forms set using the transfer type of pressure-sensitive copying paper comprises an upper sheet (usually known as a "CB" sheet) coated on its lower surface with microcapsules containing a solution in an oil solvent or solvent composition of at least one chromogenic material (alternatively termed a colour former) and a lower sheet (usually known as a "CF" sheet) coated on its upper surface with a colour developer composition. If more than one copy is required, one or more intermediate sheets (usually known as "CFB" sheets) are provided, each of which is coated on its lower surface with microcapsules and on its upper surface with colour developer composition. Imaging pressure exerted on the sheets by writing, typing or impact printing (e.g. dot matrix or daisy-wheel printing) ruptures the microcapsules, thereby releasing or transferring chromogenic material solution on to the colour developer composition and giving rise to a chemical reaction which develops the colour of the chromogenic material and so produces a copy image.

In a variant of the above-described arrangement, the solution of chromogenic material may be present as dispersed droplets in a continuous pressure-rupturable matrix instead of being contained within discrete pressure-rupturable microcapsules.

In another type of pressure-sensitive copying system, usually known as a self-contained or autogeneous system, microcapsules and colour developing co-reactant material are coated onto the same surface of a sheet, and writing or typing on a sheet placed above the thus-coated sheet causes the microcapsules to rupture and release the solution of chromogenic material, which then reacts with the colour developing material on the sheet to produce a coloured image.

The solvents used to dissolve the chromogenic materials in pressure-sensitive copying papers as described above have typically been hydrocarbon products derived from petroleum or coal deposits, for example partially hydrogenated terphenyls, alkyl naphthalenes, diarylmethane derivatives, dibenzyl benzene derivatives or derivatives of hydrocarbon products, for example chlorinated paraffins. These "prime solvents" are usually mixed with cheaper diluents or extenders such as kerosene, which although of lesser solvating power, give rise to more cost-effective solvent compositions.

Vegetable oils have been disclosed as solvents for use in pressure-sensitive copying papers, and are in principle an alternative to the use of petrochemical-based solvent compositions. However, to the best of our knowledge, there has been no significant commercial utilization of vegetable oil solvents in pressure-sensitive copying papers before the priority date hereof, even though proposals for use of vegetable oil solvents go back many years, see for example U.S. Pat. Nos. 2,712,507; 2,730,457 and 3,016,308.

More recent disclosures of the use of vegetable oil solvents in pressure-sensitive copying paper are to be found, for example, in U.S. Pat. Nos. 4,783,196 and 4,923,641 (column 6 in both cases) and in European Patent Applications Nos. 86636A (page 4), 155593A (page 11), and, especially, in European Patent Application No. 262569A. The last-mentioned is of particular interest as it is specifically directed to the use of vegetable, animal or mineral oil solvents in pressure-sensitive copying paper. In contrast, the references to vegetable oil solvents in the other patents just referred to were generally made in passing, the main subject of the patent not being concerned with solvent compositions at all.

European Patent Application No. 262569A requires the use of triphenylmethane leuco dye chromogenic materials in conjunction with the vegetable, animal or mineral oils disclosed. These triphenylmethane leuco dyes are preferably carbinols or $C_1$ to $C_4$ alkoxy derivatives of carbinols. Such carbinols or carbinol derivatives differ from the phthalide chromogenic materials, e.g. Crystal Violet Lactone ("CVL") and fluoran chromogenic materials which have hitherto been the most widely used chromogenic materials in the art. A requirement for the replacement of tried and tested phthalide and fluoran chromogenic materials by relatively unproven, or at least less well-established, chromogenic materials of the triphenylmethane carbinol or carbinol derivative type would be a significant drawback to the use of vegetable oil solvents.

An important consideration in our evaluation of vegetable oil solvents has therefore been that these solvents should be capable of satisfactory use with well-established chromogenic materials of the phthalide and fluoran type. We have found that although most of the widely-used phthalide and fluoran chromogenic materials are somewhat less effective in vegetable oil solvents than in conventional hydrocarbon solvents, they can be used satisfactorily with vegetable oil solvents, without major problems in relation to either solubility or colour generating capability. However we did encounter one or more of the following problems:

1. Wide Primary Droplet Size Distribution on Emulsification

In order to encapsulate the oils, they must first be emulsified in an aqueous medium. The size of the droplets in this emulsion is a key parameter in determining the size of the final microcapsules. Wide variations in primary droplet size, and hence in microcapsule size, are disadvantageous, particularly in the case of excessively large microcapsules. These are particularly prone to damage and accidental rupture, and may also be more permeable than smaller capsules (i.e. the capsule contents are less well retained by the microcapsule walls and therefore can escape prematurely). This results in production of coloured spots and in general discolouration in CFB paper, since in a wound reel of CFB from the coating machine, the capsule coated (CB) surface of each ply within the reel is in close contact with the colour developer (CF) surface of the adjacent ply. Spot formation can also occur in finished pressure-sensitive copying sets, where CB and CF surfaces are also in contact.

In considering the problems just described, it should be borne in mind that the volume of chromogenic material solution in a spherical droplet is proportional to the cube of the radius of the droplet, and that what may seem to be a relatively minor oversizing can have very significant effects in the final product.

A wide primary droplet size distribution can also exacerbate the problem of post-printing discolouration (see below).

2. Post-Printing Discolouration

When CB and CFB papers are subjected to a printing process as part of the production of business forms sets, a certain amount of microcapsule damage tends to occur, and this results in release of chromogenic material solution which can transfer to an adjacent CF surface and produce discolouration as a result of formation of many small coloured specks. This is known as "post-printing discolouration" (or "post-print blacking", or "post-print blueing", depending on the colour of the copy image).

3. Discolouration on Storage

It is found that CFB paper sometimes tends to discolour gradually on storage prior to use. The reasons for this include the presence in the microcapsule coating of a small proportion of unencapsulated chromogenic material solution, gradual permeation of chromogenic material solution through the microcapsule walls, and premature capsule damage as a result of the strains imposed by reel tensions, or by the weight of higher sheets in the case of stacked sheeted products. In each case, the free chromogenic material solution can potentially migrate up through the paper and into contact with the colour developer coating on the top surface. The effect is primarily seen as an overall greying (or blueing in the case of a blue-copy product) and is referred to generally as discolouration on storage.

We found earlier that the above-described problems can be eliminated or at least reduced, and also that an improved copy intensity can be obtained, if the vegetable oil solvent is used in conjunction with an ester of certain organic acids. This combination is the subject of our pending European Patent Application No. 520639A (which was unpublished at the priority date hereof). The acids in question are non-aromatic monocarboxylic acids having a saturated or unsaturated straight or branched hydrocarbon chain with at least three carbon atoms in the chain.

However, we found when we evaluated vegetable oils which are solid or semi-solid under normal conditions of use of the record material (i.e. which have a melting point of around ambient temperature (20°–25° C.) or above, that although a wide primary droplet size distribution was obtained on emulsification, the problems of post-printing discolouration and discolouration on storage were significantly less than experienced with lower-melting vegetable oils. The elimination or reduction of post-printing discolouration and/or discolouration on storage without the use of relatively expensive ester materials is believed to be a significant advance in the art. A further benefit which we have observed when using higher-melting vegetable oils is that the copy image obtained tends to be more resistant to fading and to give better image sharpness than comparable images obtained when using lower-melting vegetable oils. We have also discovered that at least one chromogenic material which is incompatible with liquid vegetable oils (because it makes them discoloured and smelly) is compatible with higher-melting vegetable oils.

U.S. Pat. No. 4,783,196 and its continuation U.S. Pat. No. 4,923,641, both already referred to, are primarily concerned with chromogenic materials, but they do list (in column 6 in each case) some classes of solvent for use with these chromogenic materials. One such class is vegetable oils, of which eleven examples are given. One of these, palm oil, is solid or semi-solid at the ambient temperatures referred to above. However, no mention is made of the fact that palm oil has a relatively high melting point and that in consequence it is solid or semi-solid at ambient temperatures. Similarly, European Patent Application No. 262569A, also already referred to above, includes (in claim 13) a list of vegetable oils, one of which, coconut oil, is solid or semi-solid at the ambient temperatures referred to above. Again, no mention is made of its solid or semi-solid nature. All the other oils listed in all three references, vegetable or non-vegetable, are liquid at ambient temperatures, including all those referred to in the specific Examples. In view of the factors just mentioned, the references to palm oil in U.S. Pat. Nos. 4,783,196 and 4,923,641 and to coconut oil in European Patent Application No. 262569A appear to be purely speculative and not specific teachings with regard to technical action (i.e. teachings actually to use palm oil).

According to the present invention, there is provided a chromogenic composition for use in pressure-sensitive record material, said composition comprising chromogenic material in a vegetable oil vehicle and being characterized in that the vehicle:

a) has a melting point such as to be solid or semi-solid at ambient temperatures of around 20°–25° C.;

b) is made up of at least a major proportion of a relatively high melting vegetable oil which is solid or semi-solid at said ambient temperatures; and c) is substantially free of esters of an acid derivable from an animal or vegetable oil.

The invention also extends to the chromogenic composition when microencapsulated and to pressure-sensitive record material comprising the chromogenic composition, either contained in microcapsules or otherwise present in the form of isolated droplets within a pressure-rupturable barrier.

The reasons why the use of higher-melting vegetable oils should provide better performance than the lower-melting vegetable oils we evaluated have not been fully elucidated. We suspect however that it is related to the solid or semi-solid state of the oil, in that microcapsules with a solid or semi-solid oil filling are less likely to rupture under accidental pressure, but that if they do, the solid or semi-solid oil is unlikely to flow very readily from accidentally ruptured microcapsules. In consequence, discolouration is minimised. Forced release of the microcapsule contents under the influence of imaging pressure (which is much higher than pressures leading to accidental microcapsule rupture) is not however impaired to an unacceptable extent, although we have observed some fall off in imaging performance compared with other lower-melting vegetable oils. This can however be compensated for in various ways, for example by small increases in the concentration of chromogenic material in the solvent composition.

Examples of suitable higher-melting vegetable oils for use in the present invention are coconut oil, palm oil, palm kernel oil and fully or partially hardened vegetable oils of appropriate melting point, for example hardened soya bean oil or hardened coconut oil. Coconut oil is currently preferred.

We have found when working with palm oil that it is difficult to microencapsulate satisfactorily using conventional gelatin coacervation microencapsulation techniques. We suspect this is because it contains relatively high mono- and di-glyceride fractions, which interact adversely with gelatin and similar microcapsule wall precursor materials. Consequently, the use of aminoplast or other synthetic capsule wall materials is desirable when using palm oil. The production of such synthetic-walled capsules is well-known in the art and is extensively described in the patent literature.

The semi-solid or solid nature of the relatively high-melting vegetable oil used in the present invention is not a problem in the encapsulation process, since this is can be conducted at a temperature above the melting point of the oil until the microcapsule wall has formed (in many commercialised encapsulation processes, this condition is already satisfied in any event). Thus the oil is in a liquid state during the encapsulation process. Once subsequently cooled down, the vegetable oil is believed to revert to a solid or semi-solid state, but the ability of the composition to generate colour on contact with a suitable colour developer is not destroyed.

The present chromogenic composition is preferably composed substantially entirely of relatively higher-melting vegetable oil as referred to above. However, it is possible to include a small proportion of liquid vegetable oil with the solid/semi-solid oil without losing the benefits obtained with the latter, provided the composition, or a major part of it, remains solid or semi-solid at the ambient temperatures referred to.

In contrast to the disclosure of European Patent Application No. 262569A, the present chromogenic composition can be substantially free of triphenylmethane carbinol or triphenylmethane carbinol ether chromogenic material.

In addition to the chromogenic material vehicle, other additives may be present, for example antioxidants to counteract the well known tendency of vegetable oils to deteriorate as a result of oxidation, provided these are compatible with the encapsulation process and chromogenic materials used.

In use, the present chromogenic composition can be microencapsulated and applied to a sheet substrate such as paper in conventional manner, so as to produce pressure-sensitive record material.

The microcapsules may be produced by coacervation of gelatin and one or more other polymers, e.g. as described in U.S. Pat. Nos. 2,800,457; 2,800,458; or 3,041,289; or by in situ polymerisation of polymer precursor material, e.g. as described in U.S. Pat. Nos. 4,001,140; 4,100,103; 4,105,823 and 4,396,670, or by interfacial techniques such as disclosed in U.S. Pat. Nos. 4,379,071; 4,428,983; 4,412,959; 4,402,856; 4,253,682 or 4,181,639.

The chromogenic materials used in the present composition may be, for example, phthalide derivatives, such as 3,3-bis(4-dimethylaminophenyl)- 6-dimethylaminophthalide (CVL) and 3,3-bis( 1-octyl-2-methylindol-3-yl)phthalide; fluoran derivatives, such as 2'anilino-6'-diethylamino-3'-methylfluoran, 6'-dimethylamino- 2'-(N-ethyl-N-phenylamino-4'-methylfluoran), 2'-N-methyl-N-phenylaminofluoran- 6'-N-ethyl-N(4-methylphenylaminofluoran, or 3'-chloro-6'-cyclohexylaminofluoran; or spirobipyran derivatives such as 3'-i-propyl-7-dibenzylamino- 2,2'-spirobi-(2H-1-benzopyran). Triphenylmethyl chromogenic materials as disclosed in European Patent Application No. 262569A may also be used.

The chromogen-containing microcapsules, once produced, are formulated into a coating composition with a suitable binder, for example starch or a starch/carboxymethylcellulose mixture, and a particulate agent (or "stilt material") for protecting the microcapsules against premature microcapsule rupture. The stilt material may be, for example, wheatstarch particles or ground cellulose fibre floc or a mixture of these. The resulting coating composition is then applied by conventional coating techniques, for example metering roll coating or air knife coating.

Apart from the chromogenic composition, the present pressure-sensitive copying paper may be conventional. Such paper is very widely disclosed in the patent and other literature, and so requires only brief further discussion.

The thickness and grammage of the present paper (before microcapsule coating) may be as is conventional for this type of paper, for example the thickness may be about 60 to 90 microns and the grammage about 35 to 50 g $m^{-2}$, or higher, say up to about 100 g $m^{-2}$ or even more. This grammage depends to some extent on whether the final paper is for CB or CFB use. The higher grammages just quoted are normally applicable only to speciality CB papers.

The colour developer material used may be an acid clay, e.g. as described in U.S. Pat. No. 3,753,761; a phenolic resin, e.g. as described in U.S. Pat. No. 3,672,935 or U.S. Pat. No. 4,612,254; or an organic acid or metal salt thereof, e.g. as described in U.S. Pat. No. 3,024,927, European Patent Application Nos. 275107A or 428994A, or German Offenlegungsschrift No. 4110354A.

The invention will now be illustrated by the following Examples in which all parts and percentages are by weight unless otherwise stated, and melting points are slip melting points, as is conventional in the vegetable oil field.

EXAMPLE 1

This illustrates the use of a chromogenic composition comprising 100% coconut oil (CNO), with 100% rapeseed oil (RSO), 100% groundnut oil (GNO), and 100% cottonseed oil (CSO) chromogenic compositions as controls for comparison purposes. The coconut oil was solid or semi-solid at ambient temperatures (melting point range 24°–26° C.) whereas the remaining oils were all liquid.

Chromogenic materials were first dissolved in the oils to produce solutions for encapsulation (the coconut oil had previously been heated to 30°–35° C. using a water bath so that it was in a liquid state). These chromogenic materials are all commercially available and have a long history of use in the art. They were a 5% total concentration mixture of CVL, a green fluoran and a black fluoran, and a red bis-indolyl phthalide, and were used in relative proportions such as to give a black print, as is conventional in the art.

The resulting chromogenic material solutions were encapsulated on a laboratory scale by means of a generally conventional gelatin coacervation technique as disclosed in British Patent No. 870476, using carboxymethyl cellulose and vinylmethylether/maleic anhydride copolymer as anionic colloids. As an initial step of the encapsulation process, the chromogenic material solution was dispersed with stirring in gelatin solution, and the resulting dispersion was then milled to a target median droplet size of 3.2±0.2 μm (as measured by means of a Coulter Counter).

The Coulter Counter was also used to measure the percentage of droplets in different size ranges, so as to permit a droplet size distribution to be derived.

The droplet size distribution was also assessed by IQD calculations (IQD=Inter-Quartile Distance). IQD is a measure of the spread of droplet size distribution and is the difference between the upper and lower quartile droplet sizes. The smaller the IQD value the narrower (i.e. better) the droplet size distribution.

The results of primary droplet size testing were as set out in Table 1a below.

TABLE 1a

| Vehicle Composition | Median Droplet Size (μm) | I.Q.D. | % Oversize* |
|---|---|---|---|
| 100% CNO | 3.2 | 1.8 | 2.6 |
| 100% RSO | 3.2 | 1.9 | 1.6 |
| 100% GNO | 3.2 | 2.0 | 1.7 |
| 100% CSO | 3.1 | 1.9 | 2.0 |

*Defined as droplets of a size greater than 6.35 μm.

It will be seen that the coconut oil gave rise to slightly lower I.Q.D. values but a higher % oversize value than the other oils.

The microencapsulation process was then completed in conventional manner. Specifically, the dispersion was diluted with additional water and vinylmethyl ether/maleic anhydride copolymer solution was added. After heating to 50°–55° C., carboxymethylcellulose solution was added. Acetic acid was then added to adjust the pH to about 4.2 and thereby bring about coacervation. The coacervate deposited about the emulsified oil droplets so as to form liquid-walled microcapsules. The mixture was then chilled to about 10° C. to solidify the initially-liquid coacervate walls, after which a hardening agent (glutaraldehyde) was added to cross-link the walls and prevent their re-dissolving when the temperature rises when the chilling operation is concluded. A further addition of vinylmethylether/maleic anhydride copolymer was then made. The resulting microcapsule dispersion was then adjusted to pH 7 with sodium hydroxide solution.

The finished microcapsule dispersion was formulated into a conventional CB coating composition using a gelatinized starch binder and a mixture of wheatstarch particles and ground cellulose fibre floc as an agent for preventing premature microcapsule rupture. This CB coating composition was applied at a range of coatweights to the uncoated surface of commercially-available 46 g $m^{-2}$ CF paper by means of a small scale metering roll coater. The CF paper utilised acid-washed dioctahedral montmorillonite clay as the active colour developing ingredient.

The resulting paper was subjected to the following tests:

1. Calender Intensity (CI) Test

This involved superimposing a strip of the microcapsule-coated paper under test onto a strip of conventional acid-washed montmorillonite colour developer coated paper, passing the superimposed strips through a laboratory calender to rupture the capsules and thereby produce a colour on the colour developer strip, measuring the reflectance of the thus-coloured strip (I) and expressing the result ($^{I}/_{I_o}$) as a percentage of the reflectance of an unused control colour developer strip ($I_o$). Thus the lower the calender intensity value ($^{I}/_{I_o}$), the more intense the developed colour.

The reflectance measurements were done both two minutes after calendering and forty-eight hours after calendering, the sample being kept in the dark in the interim. Measurements were made both after two minutes and after forty-eight hours, so as to allow for the effect of additional colour development with time.

In each case the calender intensity value is indicative of the ability of the microcapsule-coated paper to give rise to a good copy image.

2. Post-Printing Discolouration—Extended Ram Test

This is intended to simulate the effect of post-printing discolouration (as described earlier). A stack of twenty CFB sheets of each sample was placed under a hydraulic ram and subjected to a nominal ram pressure of 1724 kPa (250 p.s.i) for 30 minutes. The extent of discolouration was assessed by comparison with visual standards.

3. Discolouration on Storage Tests i. Contact Storage

A stack of twenty CFB sheets of each sample, all with their CF surfaces uppermost, were placed under a 2 kg weight in an oven at 60° C. for 3 weeks. The extent of discolouration on the CF surfaces was assessed visually.

ii. Accelerated Ageing

Single CFB sheets of each sample were placed in ovens under the following conditions, which are believed to simulate the effect of extended storage prior to use in various parts of the world, particularly those with hot climates where discolouration on storage is most problematical.

| |
|---|
| 3 weeks at 40° C. |
| 3 weeks at 60° C. |
| 3 days at 32° C. and 90% relative humidity |
| 1 week at 32° C. and 90% relative humidity |

Again, the extent of discolouration on the CF surfaces was assessed visually.

The results of calender intensity tests are set out in Table 1b below:

TABLE 1b

| Vehicle Composition | Dry CB Coatweight (g $m^{-2}$) | Calender Intensity 2 min. | Calender Intensity 48 hours |
|---|---|---|---|
| 100% | 5.1 | 71.4 | 66.4 |
| CNO | 4.6 | 71.2 | 67.5 |
| | 4.3 | 73.1 | 67.4 |
| 100% | 5.0 | 67.4 | 62.7 |
| RSO | 4.3 | 67.6 | 62.8 |
| (control) | 4.2 | 67.6 | 63.0 |
| 100% | 4.7 | 74.0 | 66.9 |
| GNO | 4.3 | 73.8 | 69.2 |
| (control) | 4.0 | 73.6 | 67.6 |
| 100% | 4.8 | 68.1 | 63.1 |
| CSO | 4.4 | 69.0 | 64.0 |
| (control) | 4.1 | 69.4 | 64.4 |

Exact comparisons are difficult because of the different dry CB coatweights obtained, but in general it will be seen that coconut oil gave somewhat less intense colouration than the other oils, with the exception of groundnut oil. No fade tsting was carried out.

In the extended ram test, coconut oil was superior in performance to rapeseed oil and cottonseed oil, and equivalent to groundnut oil.

In the contact storage tests (visual assessment) the coconut oil samples showed significantly lower discolouration than the samples using the other oils.

In the accelerated ageing tests (also visual assessment), the extent of sheet discolouration was low for all samples at a 40° C. storage temperature. At 60° C., the coconut oil samples show significantly lower discolouration than the samples using the other oils. However, this benefit was not maintained in the very severe 32° C./90% RH test.

It can be concluded from the above results that although coconut oil had similar or worse primary droplet size characteristics than the other vegetable oils tested, the discolouration performance of coconut oil was better than the other oils tested once the oils had been encapsulated and used in a pressure-sensitive copying paper system.

EXAMPLE 2

This illustrates the use of three further relatively high-melting vegetable oils as follows:

| Oil | | Melting Point (°C.) |
|---|---|---|
| Palm oil | (PO) | 30–38 |

-continued

| Oil | | Melting Point (°C.) |
|---|---|---|
| Palm kernel oil | (PKO) | 31–33 |
| Hardened soybean oil | (HSBO) | 20–26 |

Rapeseed oil (RSO, liquid at room temperature) and coconut oil (CNO, melting point 24°–26° C.) were also evaluated for comparison purposes.

The procedure was generally as described in Example 1 except that:

(a) the encapsulation was carried out on pilot-plant scale, and coating was carried out on a larger metering roll coater, albeit still a pilot-scale coater;

(b) the milling time required to reach the target median droplet size was noted;

(c) the chromogenic materials were a 6.4% total concentration mixture of CVL, green and black fluorans, and a red bis-indolyl phthalide, used in relative proportions such as to give a black print; and (d) each CB coating composition was applied at a range of coatweights.

The milling times and results of primary droplet size testing were as set out in Table 2a below.

TABLE 2a

| Vehicle Composition | Milling Time (min.) | Median Droplet Size (μm) | I.Q.D. | % Oversize* |
|---|---|---|---|---|
| PO | 37 | 3.2 | 2.1 | 3.3 |
| PKO | 53 | 3.1 | 1.9 | 2.3 |
| HSBO | 70 | 3.2 | 2.2 | 3.8 |
| CNO | 45 | 3.1 | 2.0 | 3.4 |
| RSO | 50 | 3.2 | 2.2 | 4.0 |

*defined as droplets of a size greater than 6.35 μm

No definite conclusions can be drawn from the data, although the low melting RSO had the highest % oversize value, and also a high IQD value (although no higher than HSBO, which also had % oversize value higher than the other high-melting oils tested).

The results of tests on the final coated products were as follows:

1. Calender Intensity

The results of calender intensity tests are set out in Table 2b below:

TABLE 2b

| Vehicle Composition | Dry CB Coatweight ($g\ m^{-2}$) | Calender Intensity 2 min. | Calender Intensity 48 hours |
|---|---|---|---|
| PO | 4.4 | 67.9 | 61.4 |
| | 4.9 | 66.4 | 59.8 |
| | 5.3 | 65.9 | 59.2 |
| | 6.1 | 66.1 | 59.7 |
| | 6.4 | 65.1 | 58.5 |
| PKO | 4.5 | 70.1 | 69.0 |
| | 4.9 | 68.8 | 66.5 |
| | 5.6 | 67.4 | 65.6 |
| | 6.2 | 67.0 | 64.7 |
| | 7.3 | 65.8 | 62.7 |
| HSBO | 3.4 | 68.5 | 62.5 |
| | 4.6 | 66.3 | 60.0 |

TABLE 2b-continued

| Vehicle Composition | Dry CB Coatweight ($g\ m^{-2}$) | Calender Intensity 2 min. | Calender Intensity 48 hours |
|---|---|---|---|
| | 5.0 | 65.4 | 59.0 |
| | 5.8 | 65.5 | 59.2 |
| | 6.6 | 64.2 | 57.8 |
| CNO | 4.3 | 66.4 | 60.0 |
| | 5.0 | 64.5 | 58.0 |
| | 5.8 | 63.7 | 57.3 |
| | 6.4 | 63.6 | 57.1 |
| | 7.3 | 62.4 | 55.8 |
| RSO | 4.5 | 65.1 | 57.9 |
| | 5.2 | 64.0 | 57.0 |
| | 5.4 | 62.7 | 56.4 |
| | 6.2 | 62.0 | 55.5 |
| | 6.9 | 60.6 | 53.7 |

It can be concluded that all of the higher-melting oils gave acceptable imaging performance, although none were as good in this respect as the low-melting rapeseed oil.

2. Post-Printing Discolouration

In the extended ram test, CNO, PKO and HSBO were less discoloured than RSO after 15 minutes ram pressure. CNO showed the least discolouration. However, PO showed about the same extent of discolouration as RSO.

After 30 minutes pressure, these differences in the extent of discolouration were less clear, perhaps because the test was too severe.

Visual assessment of samples which had actually been printed showed that CNO, PKO and HSBO were all less discoloured than RSO, but that PO was about the same.

3. Discolouration on Storage

In both the contact storage and accelerated ageing tests (32° C. and 90% relative humidity), CNO, PKO and HBSO all showed less discolouration than RSO. PO had about the same level of discolouration as RSO.

It can be concluded from the foregoing that three of the high-melting oils, namely CNO, PKO and HBSO, showed benefits compared with the low-melting RSO, whereas PO did not. As previously mentioned, it is felt that the relatively poor results obtained with PO are probably connected with its composition, in particular its relatively high level of mono- and di-glycerides, which make it difficult to encapsulate and to retain within gelatin microcapsule walls.

4. Fading

It was noted that all the high melting oils, including PO, gave an image which was less subject to fading than the image obtained with the low melting RSO.

EXAMPLE 3

This illustrates the use of a further hardened vegetable oil, namely hardened coconut oil (HCNO), and compares the results obtained with those for unhardened coconut oil (CNO). The melting point of the HCNO was 32°–35° C.

The procedure was as generally described in Example 2. the same chromogenic materials in the same concentration (6.4%) were used as in Example 2.

The milling times and results of primary droplet size testing were as set out in Table 3a below.

TABLE 3a

| Vehicle Composition | Milling Time (min.) | Median Droplet Size (μm) | I.Q.D. | % Oversize* |
|---|---|---|---|---|
| HCNO | 58 | 3.1 | 1.9 | 2.2 |
| CNO | 50 | 3.2 | 1.9 | 1.9 |

*defined as droplets of a size greater than 6.35 μm

The results of tests on the final coated products were as follows:

1. Calender Intensity

The results of calender intensity tests are set out in Table 3b below:

TABLE 3b

| Vehicle Composition | Dry CB Coatweight ($g\ m^{-2}$) | Calender Intensity 2 min. | Calender Intensity 48 hours |
|---|---|---|---|
| HCNO | 4.1 | 70.3 | 64.5 |
| | 4.8 | 69.3 | 63.1 |
| | 5.3 | 67.7 | 61.5 |
| | 6.1 | 67.6 | 61.7 |
| | 6.6 | 67.2 | 61.1 |
| CNO | 4.1 | 67.7 | 61.5 |
| | 5.0 | 66.6 | 60.4 |
| | 5.2 | 65.2 | 59.1 |
| | 6.0 | 67.0 | 61.0 |
| | 6.8 | 64.5 | 58.1 |

It will be seen that although HCNO gave a reduced colouration intensity compared with CNO, the difference was not great. Since CNO had been shown in previous Examples to give acceptable imaging performance, it can be concluded that HCNO also gives acceptable imaging performance.

2. Post-Printing Discolouration

In the extended ram test, HCNO gave very slightly less discolouration than CNO.

Visual assessment of samples which had actually been printed showed HCNO to give significantly less discolouration than CNO.

3. Discolouration on Storage

In both contact storage and accelerated ageing tests (32° C. and 90% relative humidity) HCNO showed less discolouration than CNO.

4. Fading

HCNO and CNO showed similar fade performance.

EXAMPLE 4

This is an investigative experiment illustrating the effect of the presence of an oil which is liquid at ambient temperatures (RSO) on the behaviour of a solid oil (CNO).

Three vegetable oil vehicles were evaluated, namely 100% CNO, 90:10 CNO:RSO, and 75:25 CNO:RSO. The procedure was generally as described in Example 1, except that the chromogenic materials used and their concentration were in each case as in Example 2.

The milling times and results of primary droplet size testing were as set out in Table 4a below.

TABLE 4a

| Vehicle Composition | Milling Time (min.) | Median Droplet Size (μm) | I.Q.D. | % Oversize* |
|---|---|---|---|---|
| CNO | 40 | 3.1 | 2.0 | 1.7 |
| 90:10 CNO:RSO | 45 | 3.1 | 1.9 | 1.1 |
| 75:25 CNO:RSO | 55 | 3.1 | 1.9 | 1.8 |

*defined as droplets of a size greater than 6.35 μm

It will be seen that the milling time increased as the proportion of RSO increased, but that median droplet size and I.Q.D. values were largely unaffected.

The results of tests on the final coated products were as follows:

1. Calender Intensity

The results of calender intensity tests are set out in Table 4b below, together with results obtained using 100% RSO in microcapsules made by the same general procedure but in a different trial.

TABLE 4b

| Vehicle Composition | Dry CB Coatweight ($g\ m^{-2}$) | Calender Intensity 2 min. | Calender Intensity 48 hours |
|---|---|---|---|
| CNO | 5.9 | 72.0 | 66.2 |
| | 5.3 | 73.2 | 67.5 |
| | 4.4 | 73.6 | 67.8 |
| | 4.3 | 73.8 | 68.0 |
| 90:10 CNO:RSO | 5.9 | 71.7 | 65.5 |
| | 4.9 | 72.7 | 66.5 |
| | 4.7 | 73.3 | 67.6 |
| | 4.0 | 73.7 | 67.7 |
| 75:25 CNO:RSO | 4.7 | 72.4 | 66.4 |
| | 4.3 | 73.1 | 67.0 |
| | 4.1 | 73.9 | 68.0 |
| | 3.5 | 74.1 | 68.4 |
| RSO | 5.7 | 64.3 | 57.4 |
| | 5.1 | 66.5 | 60.4 |
| | 4.8 | 66.9 | 60.9 |
| | 4.0 | 68.1 | 62.1 |

It will be seen that 100% RSO gave better results than 100% CNO. The inclusion of a small proportion of RSO in the CNO gave a small but measurable improvement in calender intensity. However, the calender intensity data even for 100% CNO indicates acceptable performance.

2. Post Printing Discolouration

In the extended ram test, the extent of discolouration with 100% RSO was by far the worse, with 100% CNO and 90:10 CNO:RSO the best. With 25% RSO, the extent of discolouration was significantly greater than with 10% RSO. The trend of these results confirms the advantages of a solid vegetable oil over a liquid vegetable oil.

3. Discolouration on Storage

In both the contact storage test (1 week at 60° C.) accelerated ageing test (32° C. and 90% relative humidity), it could be seen from visual examination that as the proportion of RSO increased, the extent of discolouration became worse.

4. Fading

It was observed that fading became slightly worse as the proportion of RSO increased.

EXAMPLE 5

This illustrates the use of the invention with a different blend of chromogenic materials from those used previously. These chromogenic materials were a 6.4% total concentration mixture of CVL, green and black fluorans, a red bis-indolyl phthalide and 1% of 2-phenyl-4-(4-diethylaminophenyl)-4-(4-methoxyphenyl)- 6-methyl-7-dimethylamino-4H-benz.3.1-oxazine (predominant isomer in a mixture). This material is currently available from Bayer under the name "Baymicron Colour Former O1", and is the subject of European Patent Application No. 187329A (Example 17). Our experience is that when this chromogenic material is used with, for example, RSO, a discoloured and smelly solution results.

The chromogenic material blend was dissolved in CNO and the solution was encapsulated and coated as described in previous Examples. The encapsulated chromogenic material solution was neither discoloured nor smelly, and the microcapsule-coated paper produced functioned satisfactorily when used in a pressure-sensitive copying set.

EXAMPLE 6

This illustrates the use of the present chromogenic composition in a synthetic microcapsule system, rather than in the gelatin microcapsule system used in previous Examples, and also demonstrates the suitability of palm oil for use in the composition when the encapsulation system is appropriately chosen.

The synthetic microcapsule system used relied on in situ polymerisation of melamine formaldehyde precondensate, and is described in more detail in our British Patent No. 2073132B. The solid oils used were CNO and PO, which were separately encapsulated and tested in parallel procedures as described below, together with an RSO control. The chromogenic materials used and their concentrations were as in Example 2.

315 g of 20% solids content acrylamide/acrylic acid copolymer ("R1144" supplied by Allied Colloids Ltd., of Bradford, England) were dissolved with stirring in 1075 g of water at 30° C. 183.4 g of 65.5% solids content melamine formaldehyde precondensate ("Dyno-Chem Resin 5110" supplied by Dyno-chem U.K. Ltd. of Duxford, Cambridgeshire, England) were added, with stirring. The pH was then adjusted to 4.0 by addition of 20% acetic acid (about 350 ml were required). 1750 g of chromogenic material solution was then added and the dispersion was milled to a target mean droplet size of 5±0.5 μm (as measured by means of a Coulter Counter).

The Coulter counter was also used to derive I.Q.D. and % oversize values, as in previous Examples. The results obtained were as set out in Table 5a below.

TABLE 5a

| Vehicle | Median Droplet Size (μm) | I.Q.D. | % Oversize* |
|---|---|---|---|
| CNO | 4.2 | 2.1 | 0 |
| PO | 5.1 | 3.2 | 1.1 |
| RSO | 5.5 | 3.2 | 0 |

*Defined as droplets of a size greater than 14 μm

It will be seen that the CNO droplet size was rather below that intended, presumably because the milling time was a little too long. This in turn led to a narrower I.Q.D. value. Apart from this, the milling behaviour of the three oils was much the same.

The microencapsulation process was then completed by adding 500 ml of water at 35° C., and allowing the mixture to react for 2 hours at 60° C. Ammonium sulphate solution was added to quench any free formaldehyde present, and the pH was then raised to 10.

The resulting microcapsule dispersion was formulated into a CB coating composition, used to produce a CFB paper, and tested, all as described in previous Examples.

The results of tests on the final coated products were as follows:

1. Calender Intensity

The results of calender intensity tests are set out in Table 5b below:

TABLE 5b

| Vehicle Composition | Dry CB Coatweight ($g\ m^{-2}$) | Calender Intensity 2 min. | Calender Intensity 48 hours |
|---|---|---|---|
| CNO | 5.1 | 72.7 | 66.8 |
| | 5.3 | 71.0 | 64.9 |
| | 6.0 | 69.7 | 63.4 |
| | 6.4 | 69.2 | 62.9 |
| | 6.9 | 67.3 | 60.8 |
| PO | 4.3 | 72.8 | 66.4 |
| | 5.2 | 72.3 | 65.8 |
| | 6.2 | 71.4 | 64.7 |
| | 6.7 | 69.9 | 63.2 |
| | 7.5 | 69.0 | 62.2 |
| RSO | 4.6 | 68.3 | 62.2 |
| | 4.9 | 67.4 | 61.4 |
| | 5.7 | 65.5 | 59.2 |
| | 6.2 | 64.6 | 58.1 |
| | 7.0 | 63.6 | 56.5 |

It can be concluded that as in previous Examples, 100% RSO gave a more intense colouration than either of the solid oils.

2. Post-Printing Discolouration

In the extended ram test (on visual assessment), CNO gave the least discolouration and RSO the worst, PO being intermediate between the two.

3. Discolouration on Storage

In the accelerated ageing test (32° C. and 90% relative humidity), visual assessment showed CNO to have the least discolouration and RSO the worst, with PO intermediate the two. Contact storage testing was not carried out, as there was insufficient sample available.

4. Fading

After 24 hours exposure in the fade test, CNO was seen to have faded least, with PO and RSO being about the same.

We claim:

1. A chromogenic composition for use in pressure-sensitive record material, said composition comprising chromogenic material in a vegetable oil vehicle, the vehicle:

having a melting point such as to be solid or semi-solid at ambient temperatures of around 20°–25° C.;

being at least a major proportion of relatively high melting vegetable oil which is solid or semi-solid at said ambient temperatures; and being substantially free of an ester of a non-aromatic monocarboxylic acid having a saturated or unsaturated straight or branched hydrocarbon chain with at least three carbon atoms in the chain.

2. A chromogenic composition as claimed in claim 1, wherein the vehicle consists essentially of relatively high melting vegetable oil.

3. A chromogenic composition as claimed in claim 1, wherein the relatively high melting vegetable oil comprises coconut oil.

4. A chromogenic composition as claimed in claim 1, wherein the relatively high melting vegetable oil comprises palm oil.

5. A chromogenic composition as claimed in claim 1, wherein the relatively high melting vegetable oil comprises palm kernel oil.

6. A chromogenic composition as claimed in claim 1, wherein the relatively high melting vegetable oil comprises a hardened vegetable oil.

7. A chromogenic composition as claimed in claim 1, wherein the chromogenic material comprises 2-phenyl-4-(4-diethylaminophenyl)-4-(4-methoxyphenyl)-6-methyl-7-dimenthylamino-4H-benz.3.1-oxazine.

8. A chromogenic composition as claimed in claim 7, wherein the relatively high-melting vegetable oil is coconut oil.

9. A chromogenic composition as claimed in claim 1, wherein the composition is substantially free of triphenylmethane carbinol or triphenylmethane carbinol ether chromogenic material.

10. A chromogenic composition as claimed in claim 1, which is microencapsulated.

11. Pressure-sensitive record material comprising a substrate carrying a chromogenic composition as claimed in claim 1.

12. A chromogenic composition as claimed in claim 2, which is microencapsulated.

13. A chromogenic composition as claimed in claim 7, which is microencapsulated.

14. A chromogenic composition as claimed in claim 9, which is microencapsulated.

15. Pressure-sensitive record material comprising a substrate carrying a chromogenic composition as claimed in claim 2.

16. Pressure-sensitive record material comprising a substrate carrying a chromogenic composition as claimed in claim 7.

17. Pressure-sensitive record material comprising a substrate carrying a chromogenic composition as claimed in claim 9.

18. Pressure-sensitive record material comprising a substrate carrying a chromogenic composition as claimed in claim 10.

19. A chromogenic composition as claimed in claim 6, wherein the hardened vegetable oil is hardened soya bean oil or hardened coconut oil.

* * * * *